US006575797B1

(12) United States Patent
Martin et al.

(10) Patent No.: US 6,575,797 B1
(45) Date of Patent: Jun. 10, 2003

(54) OIL DRAIN SYSTEM FOR AN OUTBOARD MOTOR

(75) Inventors: Wesley R. Martin, Fond du Lac, WI (US); Bernard E. Ritger, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 10/140,467

(22) Filed: May 7, 2002

(51) Int. Cl.[7] ..... B63H 21/38
(52) U.S. Cl. ..... 440/88
(58) Field of Search ..... 184/1.5; 440/88, 440/900, 76, 77

(56) References Cited

U.S. PATENT DOCUMENTS 4,452,194 A 6/1984 Watanabe ..... 123/195
4,611,559 A 9/1986 Sumigawa ..... 123/196
4,828,519 A 5/1989 Watanabe ..... 440/88
5,199,914 A 4/1993 Marsh ..... 440/88
6,099,374 A 8/2000 Watanabe et al. ..... 440/88
6,126,499 A 10/2000 Katayama et al. ..... 440/88

*Primary Examiner*—Ed Swinehart
(74) *Attorney, Agent, or Firm*—William D. Lanyi

(57) ABSTRACT

An oil drain system for an outboard motor provides an oil drain opening formed in a lower surface of the splash plate of the outboard motor at a location which allows oil to drain from the oil drain opening under the force of gravity in a downward direction without contacting any surfaces of the outboard motor. This allows the oil to be received by a waste oil container that is placed at any point directly below the oil drain opening, either on the ground below the gearcase of the outboard motor or at any other point that is vertically below the oil drain opening.

29 Claims, 8 Drawing Sheets

OIL DRAIN SYSTEM FOR AN OUTBOARD MOTOR

BACKGROUND OF THE INVENTION

1. Field of the Invention

The present invention is generally related to an oil draining system for an outboard motor and, more particularly, to a draining system that provides an oil drain opening at a location which prevents oil from being spilled on other surfaces of the outboard motor during the oil draining procedure.

2. Description of the Prior Art

Internal combustion engines require lubrication to prevent excessive wear and damage to portions of the engine that are disposed in sliding association with other components. In four cycle engines, it is common and well known to use an oil sump to contain a quantity of oil that is conducted under pressure to various portions of the engine at where frictional contact between sliding components occurs. Four cycle engines used in outboard motors similarly require an oil sump to contain a quantity of liquid oil that is used for these purposes. Draining oil from an outboard motor can be a difficult and messy task because of the typical locations where drain orifices are placed in known outboard motor applications. Many outboard motor designs provide a drain opening location that makes it very difficult to avoid spilling oil on external surfaces of the outboard motor. Additionally, many locations where drain openings are provided require that a container be continually held in place under the drain opening to receive the used oil being drained from the oil sump.

U.S. Pat. No. 6,099,374, which issued to Watanabe et al on Aug. 8, 2000, describes a lubrication and oil drain system for a four cycle outboard motor. The outboard motor has a multi-cylinder four cycle, internal combustion engine as a power plant. The engine is provided with an oil reservoir in the upper portion of the driveshaft housing and lower unit. Oil is drained back to this oil reservoir by separate drain passages provided in the cylinder head and in the crankcase. In addition, an improved crankcase ventilating system is provided wherein the crankcase ventilating gases follow a circuitous path through the crankcase chamber, camshaft chambers and then to the intake system so as to reduce the emissions of hydrocarbons.

U.S. Pat. No. 5,199,914, which issued to Marsh on Apr. 6, 1993, describes a four stroke outboard motor crankcase oil drain plug opening attachment. The four stroke outboard motor crankcase drain plug opening attachment is described to facilitate drainage and collection of crankcase oil from four cycle outboard motors. The attachment includes a manually operable valve attached by a fitting to the motor drain plug opening. The valve extends to a flexible downspout that extends on downwardly to an auxiliary plug at a bottom end thereof. The valve includes an operator that can be rotated selectively to open and close the valve. The plug can be selectively removed and adds a redundancy feature to facilitate unintentional drainage of oil by operation of the valve. An oil drainage collector including opening and a top end and a bale mounted thereon, may be selectively secured over the valve to facilitate collection of oil. The opening and downspout, and bale are related dimensionally such that the collector container cannot swing free of the downspout when the bale is secured over the valve.

U.S. Pat. No. 4,828,519, which issued to Watanabe on May 9, 1989, describes an outboard motor with an improved lubricating system for the internal combustion engine of the outboard motor. A lubricant sump is positioned beneath the engine and oil is returned to the sump through a drain opening in a spacer plate that separates the engine from the driveshaft housing. The oil sump and drain opening are configured so that oil will not return from the sump through the drain opening to the engine when the outboard motor is laid on its side edge.

U.S. Pat. No. 4,611,559, which issued to Sumigawa on Sep. 16, 1986, describes an outboard motor provided with a four stroke engine. Several embodiments of outboard motors with four cycle engines and improved lubricating systems are described. In all of the embodiments, an oil reservoir is provided in the driveshaft housing and a combined screen and drain plug assembly filters the oil flowing from the oil reservoir to the engine lubricating system and for facilitating servicing of the screen by removal of the drain plug. In one embodiment, the oil reservoir is formed integrally with the driveshaft housing. A pressure relief valve depends in to the oil reservoir and is carried by a plate that connects the engine to the driveshaft housing for facilitating servicing and reducing the likelihood of leakage back of oil to the engine when the outboard motor is tilted up. An improved relief valve screen assembly is also illustrated in one embodiment where the screen may be bypassed if it becomes clogged.

U.S. Pat. No. 6,126,499, which issued to Katayama et al on Oct. 3, 2000, describes an oil pan arrangement for a four cycle outboard motor. The four cycle outboard motor has a water cooled engine and an oil pan that is formed in the upper portion of the driveshaft housing. An exhaust pipe collects exhaust gases from an exhaust guide and delivers to a cavity that is formed in the oil pan by an interior wall thereof. The exhaust pipe does not terminate below the lower surface of the oil pan and idle exhaust gases are delivered between the exterior of the exhaust pipe and interior surface of the oil pan that defines the cavity. These exhaust gases are discharged to the atmosphere through and above the water exhaust gas discharge. The oil pan lower surface has a drain opening that is aligned with a vertical drain opening in the driveshaft housing.

U.S. Pat. No. 4,452,194, which issued to Watanabe on Jun. 5, 1984, describes an outboard motor. A water cooled, four cycle internal combustion engine is particularly adapted for use in an outboard motor. A support plate arrangement is used with the supporting plate extending across the driveshaft housing at its upper end. The engine is supported on the upper side of the supporting plate and an oil pan is supported on the underside of the supporting plate and depends into the driveshaft housing. The construction is such the engine may be removed from the supporting plate without necessitating removal of the oil pan from the supporting plate so as to facilitate servicing. In addition, an oil drain is provided through the supporting plate at such a location so as to insure against leakage from the lubricant from the oil sump back into the engine regardless of whether the engine is in its normal running condition or its tilted up condition. The engine also includes an improved lubricating system for insuring good pressure lubrication of all components while minimizing the number of oil passages and avoiding the use of external oil conduits.

The patents described above are hereby expressly incorporated by reference in the description of the present invention.

Known outboard motor oil drain systems typically include an oil drain orifice that is located at a position on the outboard motor which has inherent disadvantages. Many of these oil drain systems require that an oil container be continually held in place near the oil drain opening to receive used oil flowing from the oil drain opening. This makes it difficult to set an oil container on the ground under the outboard motor to receive the oil without continued attention by the operator draining the oil. Other known systems place the oil drain opening at a location which makes it exceedingly difficult to drain all of the oil from the oil sump without spilling some oil on the external surfaces of the outboard motor.

It would be significantly beneficial if an oil drain system for an outboard motor could be constructed in such a way that the person draining the oil can simply place an oil receiving container on the ground under the outboard motor and leave the outboard motor unattended during the draining process. It would be even more beneficial if such a system could be configured in a way that avoids the spillage of oil on any surface of the outboard motor during the oil draining process.

SUMMARY OF THE INVENTION

An oil draining system for an outboard motor, made in accordance with a preferred embodiment of the present invention, comprises an oil sump reservoir having a bottom portion and a driveshaft housing in which the oil sump reservoir is disposed. It also comprises an oil drain opening formed in a surface of the outboard motor, the surface being generally horizontal when the outboard motor is attached to a transom of a marine vessel. The oil drain opening is disposed below all other portions of the outboard motor which are intersected by a vertical line through the oil drain opening when the outboard motor is attached to the transom of the marine vessel. As a result, liquid oil draining from the oil drain opening under the force of gravity, along the vertical line, will not contact any other portions of the outboard motor as it passes those portions in a downward direction. This characteristic of the present invention allows the used oil to be received by a container placed on the ground under the outboard motor without the requirement that the person draining the oil either hold the container in place or cause it to be held in place above the ground level or result in spillage of oil on the outer surfaces of the outboard motor.

The surface of the outboard motor, in a preferred embodiment, is a lower surface of a splash plate of the outboard motor. The oil drain opening is laterally offset from all surfaces of the outboard motor which are located in a direction below the splash plate when the outboard motor is attached to the transom of the marine vessel. The oil sump reservoir, in a preferred embodiment, is a separate container which is disposed in a cavity of the driveshaft housing which is shaped to receive the oil sump reservoir. A transition drain conduit has a first end connected in fluid communication with an internal cavity of the oil sump reservoir and the transition drain conduit has a second end located at the oil drain opening.

A protective conduit housing is integrally formed within the structure of the driveshaft housing and has a first end which is shaped to receive the transition drain conduit. It has a second end which serve as the oil drain opening and receives the second end of the transition drain conduit. The protective conduit housing is contained within a protruding rib which is formed as part of the driveshaft housing and which extends from the second end of the protective conduit housing which is proximate the plate portion to the first end of the protective conduit housing which connects to the cavity in the driveshaft housing. The transition drain conduit, in a preferred embodiment, is generally L-shaped and extends from the bottom portion of the oil sump. The transition drained conduit is disposed partially within the sump cavity of the driveshaft housing, external to the oil sump reservoir. A plug is shaped to be received in threaded association by the second end of the transition drain conduit. The oil drain opening contains the second end of the transition drain conduit and is located at a position which is forward of a propeller of the outboard motor when the outboard motor is attached to the transom of the marine vessel. The oil drain opening is located at a port side of the outboard motor when the outboard motor is attached to the transom of the marine vessel.

BRIEF DESCRIPTION OF THE DRAWINGS

The present invention will be more fully and completely understood from a reading of the description of the preferred embodiment of the present invention, in conjunction with the drawings, in which.

DESCRIPTION OF THE PREFERRED EMBODIMENT

Figure 1:
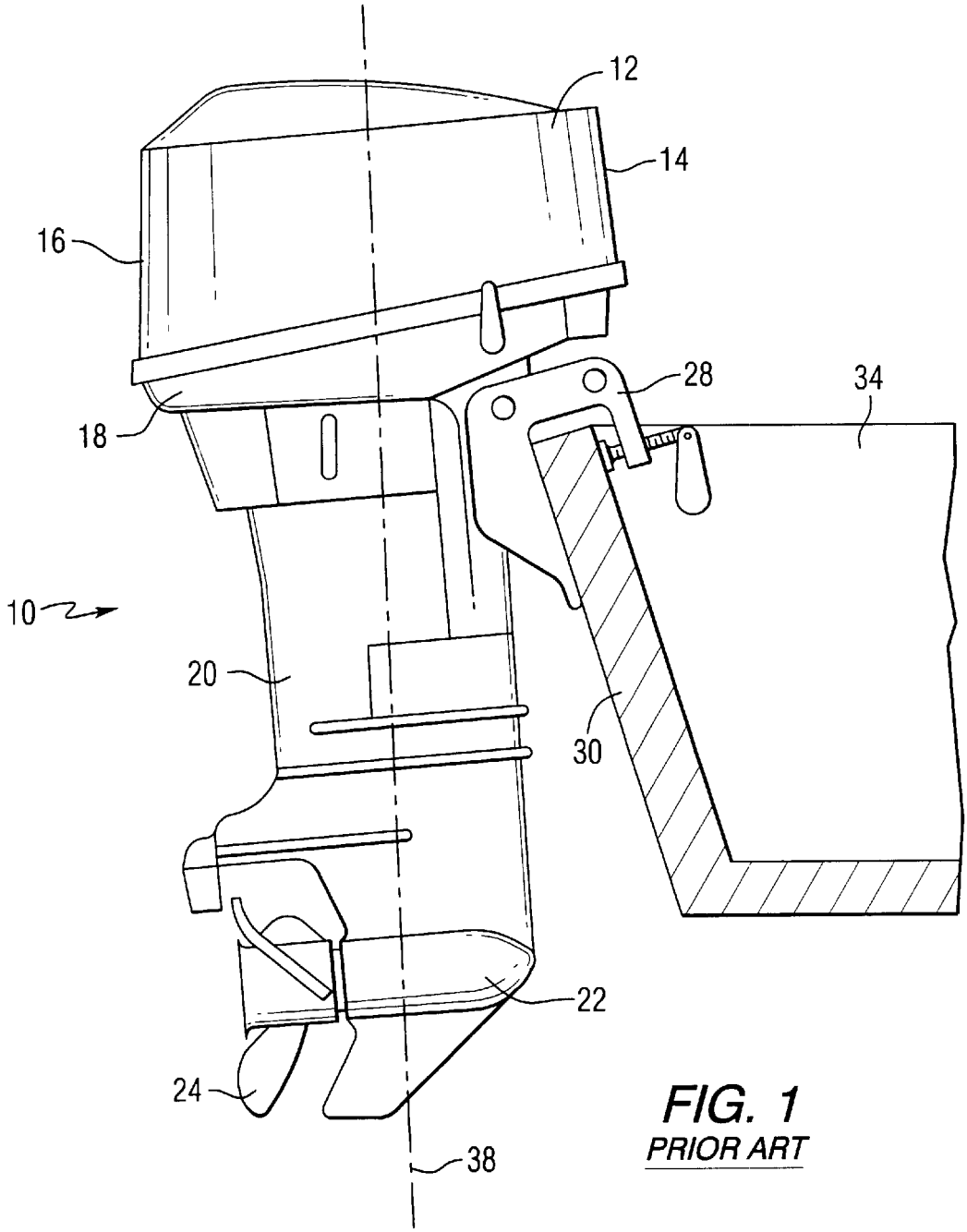
FIG. 1 PRIOR ART
FIG. 1 illustrates the known configuration of an outboard motor attached to a marine vessel.

Throughout the description of the preferred embodiment of the present invention, like components will be identified by like reference numerals.

FIG. 1 shows an outboard motor 10 of the type that is well known to those skilled in art. An internal combustion engine is housed under a cowl 12 which has a front side 14 and a rear side 16. The cowl 12 is typically attached to a lower cowl portion 18 or support plate. A driveshaft housing 20 extends downwardly from the internal combustion engine and houses the driveshaft. A gearcase 22 is attached to the driveshaft housing 20 and contains a propeller shaft to which a propeller 24 is attached for rotation. A transom bracket 28 allows the outboard motor to be attached to a transom 30 of a marine vessel 34.

In the description of the preferred embodiment of the present invention, below, reference is made to various relative positions of various components of an outboard motor. For purposes of clarity, those references regarding relative positions will consistently refer to the position illustrated in FIG. 1, whereas the outboard motor 10 is attached to the transom 30 of a marine vessel 34. When attached to the transom 30, the driveshaft within the driveshaft housing 20 is disposed parallel to a generally vertical line 38. It is not critical that the outboard motor driveshaft be precisely parallel to the vertical line 38, since the outboard motor 10 can be slightly trimmed to move the propeller 24 either toward the transom 30 or slightly away from the transom 30. However, the relative positions of various components of the present invention, as will be described in greater detail below, refer to the relative position of the outboard motor 10 when the outboard motor is supported by the transom 30 in a manner generally shown in FIG. 1. This is intended to distinguish this position shown in FIG. 1 from alternative positions in which the outboard motor can be disconnected from the transom 30 and laid on its side or on its back during transit or storage.

Figure 2:
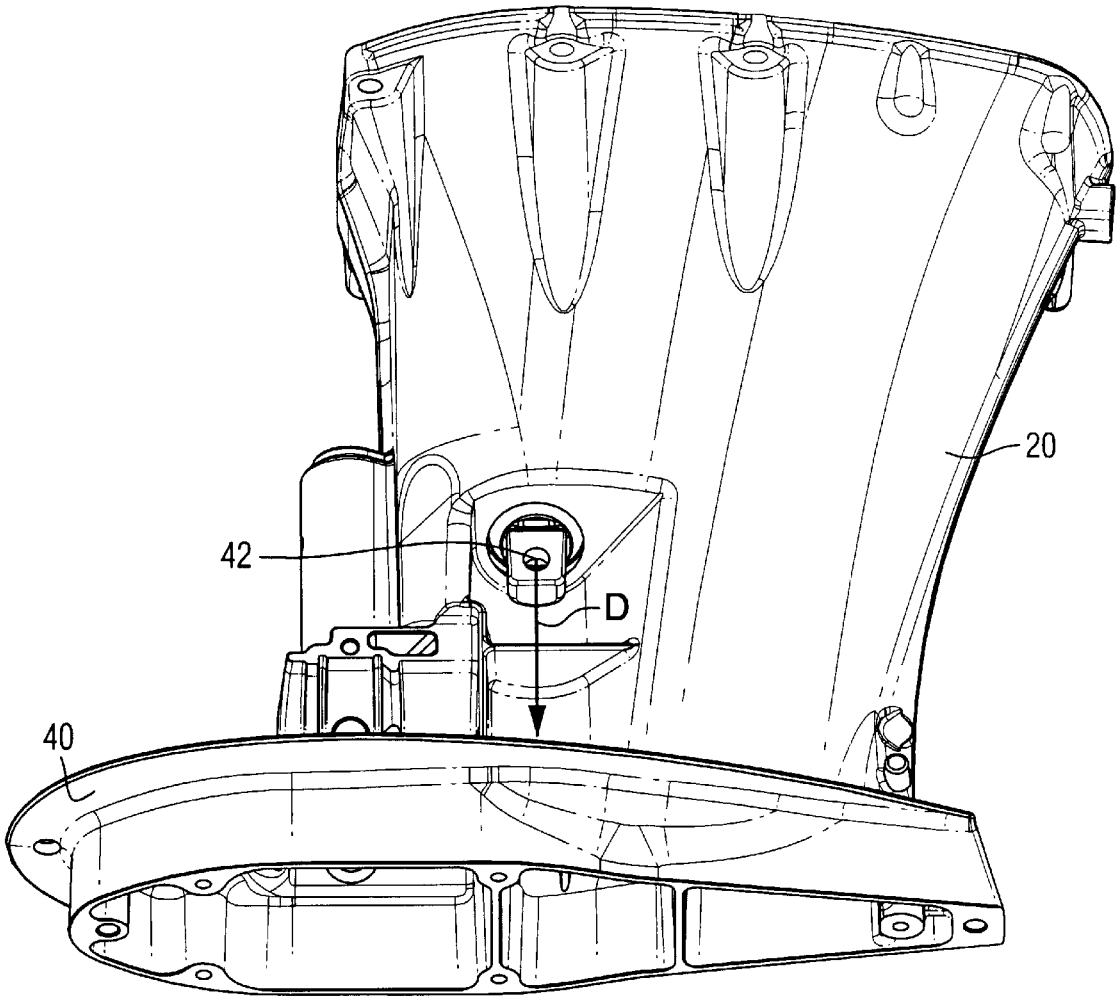
FIG. 2 PRIOR ART
FIG. 2 shows a known type of driveshaft housing with an oil drain opening.

FIG. 2 is an isometric view of a known driveshaft housing 20. A splash plate 40 is formed as an integral part of the driveshaft housing 20 and extends, as shown in FIG. 2, in a forward direction (toward the left in FIG. 2) from the driveshaft housing. An oil drain opening 42 is provided to allow used oil to be drained from an oil sump contained within the driveshaft housing 20. As represented by arrow D in FIG. 2, oil draining from the oil drain opening 42 will naturally flow under the force of gravity in a downward direction and strike the upper surface of the splash plate 40 unless the person draining the oil holds an oil container directly under the oil drain opening 42 and above the upper surface of the splash plate 40. In addition, as the flow of oil from the oil drain opening 42 diminishes in response to the oil reservoir being essentially drained, the viscosity of the oil has a tendency to cause it to cling to the vertical surface surrounding the oil drain opening 42 and run along the surface of the driveshaft housing 40 downwardly toward the splash plate 40. This creates a messy situation that will require the operator of the outboard motor to clean the surface where the oil has seeped downwardly from the oil drain opening 42.

Figure 3:
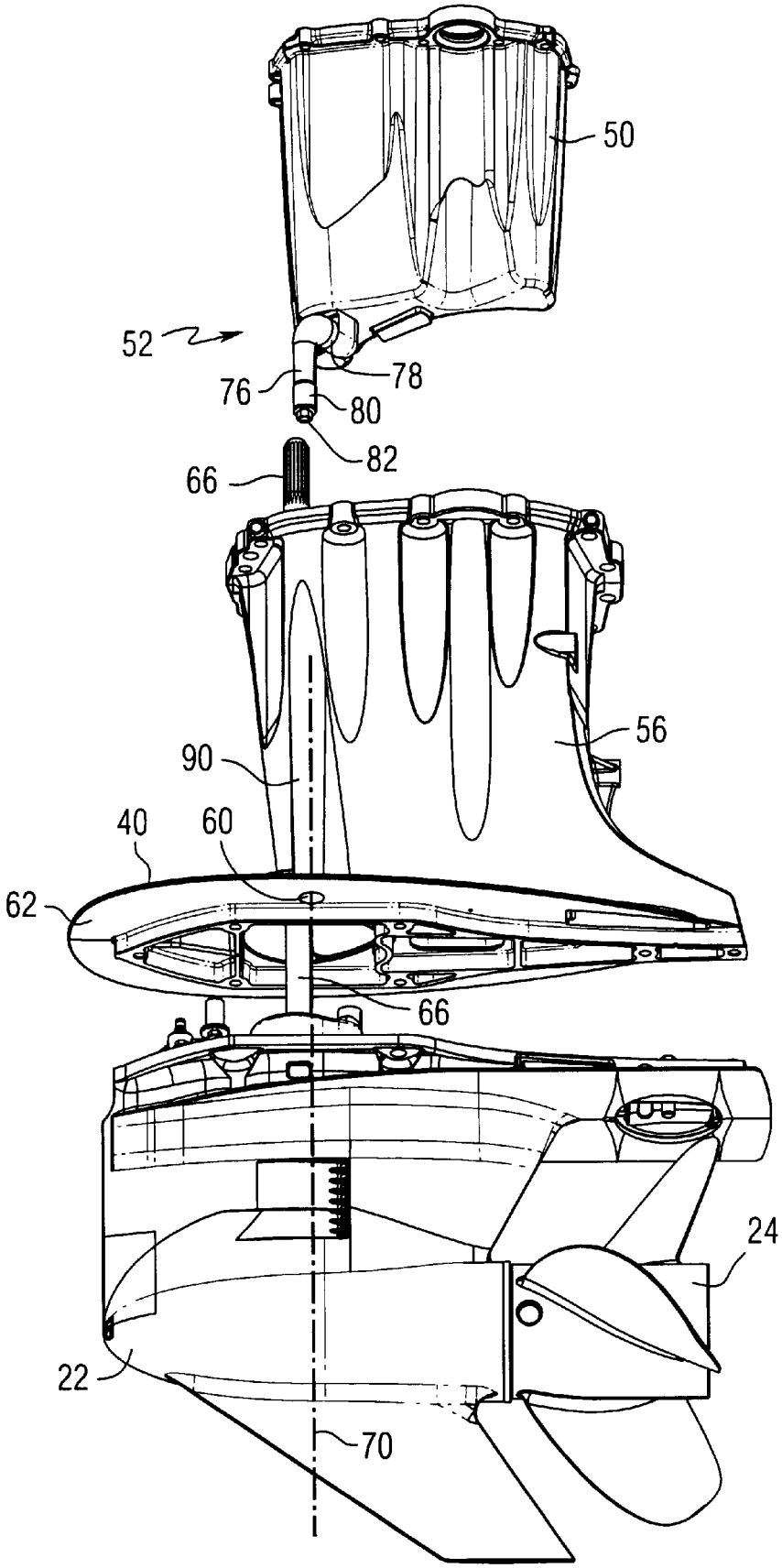
FIG. 3 an exploded isometric view of the present invention.

FIG. 3 is an exploded isometric view of the present invention. An oil sump reservoir 50 has a bottom portion 52. A driveshaft housing 56 is provided with a sump cavity (not visible in FIG. 3) that is shaped to receive the oil sump reservoir 50 within it. An oil drain opening 60 is formed in a lower surface 62 of the splash plate 40. The lower surface 62 is generally horizontal when the outboard motor 10 is attached to the transom 30 of a marine vessel 34 as discussed above in conjunction with FIG. 1. For purposes of reference to FIG. 1, the driveshaft 66 is generally parallel to the vertical line 38 shown in FIG. 1. When the outboard motor 10 is attached to the transom 30 of the marine vessel 34, the driveshaft 66 is generally vertical and parallel to line 38. As will be described in greater detail below, the oil drain opening 60 is disposed below all other portions of the outboard motor 10 which are intersected by a vertical line that extends through the oil drain opening 60 and the second end 80 of the transition drain conduit 76 when the outboard motor is attached to the transom of the marine vessel. For purposes of further explaining this characteristic of the present invention, a vertical line 70 is shown intersected the oil drain opening 60 and extending upwardly and downwardly from the oil drain opening 60. The oil drain opening 60 is the lowest part of the outboard motor that is intersected by the vertical line 70. Therefore, the oil drain opening 60 is disposed below all other portions of the outboard motor that are intersected by the vertical line 70. As a result, liquid oil draining from the oil drain opening 60 under the force of gravity will fall downwardly along the vertical line 70 and will not contact any other portions of the outboard motor. As a result, an oil container can be located on the ground below the oil drain opening and that oil container will receive all of the drained oil without causing any drained oil to spill on other surfaces of the outboard motor. In addition, since the oil drain opening 60 is located in a horizontal lower surface 62, oil will not tend to run along that surface 62 as the flow of oil diminishes because the oil sump reservoir 50 is completely drained.

With continued reference to FIG. 3, the surface 62 in which the oil drain opening 60 is formed is a lower surface of the splash plate 40 of the outboard motor. As will be described in greater detail below, the oil drain opening 60 is laterally offset from all surfaces of the outboard motor which are located in a direction below the splash plate 40 when the outboard motor is attached to the transom 30 of the marine vessel 34. In the embodiment shown in FIG. 3, the oil sump reservoir 50 is a separate container which is disposed in a cavity of the driveshaft housing 56. Alternative embodiments could provide an oil sump reservoir 50 that is an integral cavity of the driveshaft housing 56.

With continued reference to FIG. 3, a transition drain conduit 76 has a first end 78 that is connected in fluid communication with an internal cavity of the oil sump reservoir 50. The transition drain conduit 76 has a second end 80 which is disposed within the oil drain opening 60. Also shown in FIG. 3 is a plug 82 which is shaped to be received in threaded association by the second end of the transition drain conduit 76.

In one embodiment of the present invention, a protective conduit housing 90 is formed within the structure of the driveshaft housing 56 and has a first end connected in fluid communication with the internal cavity of the driveshaft housing 56 to receive the transition drain conduit 76. In other words, the transition drain conduit 76 extends downwardly into an internal cylindrical passage formed within the protective conduit housing 90. The second end 80 of the transition drain conduit extends downwardly into the oil drain opening 60, with the plug 82 being accessible at the oil drain opening 60 of the lower surface 62. It should be understood that the oil drain opening 60 is the second end, or lower terminus, of the internal cylindrical passage that is formed within the protective conduit housing 90. In other words, the internal cylindrical passage extends upwardly from the oil drain opening 60 and into the internal cavity of the driveshaft housing 56 which is shaped to receive the oil pump reservoir. That internal cylindrical passage is shaped to receive a portion of the transition drain conduit that extends downwardly through it from the bottom portion 52 of the oil sump reservoir 50. The protective conduit housing 90, in a preferred embodiment, is a protruding rib extending outwardly from the outer surface of the driveshaft housing 56, as illustrated in FIG. 3. The transition drain conduit 76 extends downwardly through the internal central passage within the protective conduit housing 90. The second end 80 of the transition drain conduit 76, and its associated plug 82, are accessible from the lower side 62 of the splash plate 40. The plug 82, in a preferred embodiment of the present invention, extends slightly below the lower surface 62 of the splash plate 40.

As shown in FIG. 3, the transition drain conduit 76 is generally L-shaped and extends from the bottom portion 52 of the oil sump reservoir 50. When the oil sump reservoir 50 is disposed within the internal cavity of the driveshaft housing 56, which is shaped to receive it, the transition drain conduit 76 is partially disposed within the sump cavity of the driveshaft housing 56. The oil drain opening 60 is located at a position which is forward of the propeller 24 of the outboard motor when the outboard motor is attached to the transom of the marine vessel. In addition, as shown in FIG.

3, the oil drain opening 60 is located at a port side of the outboard motor when the outboard motor is attached to the transom of the marine vessel.

Figure 4:
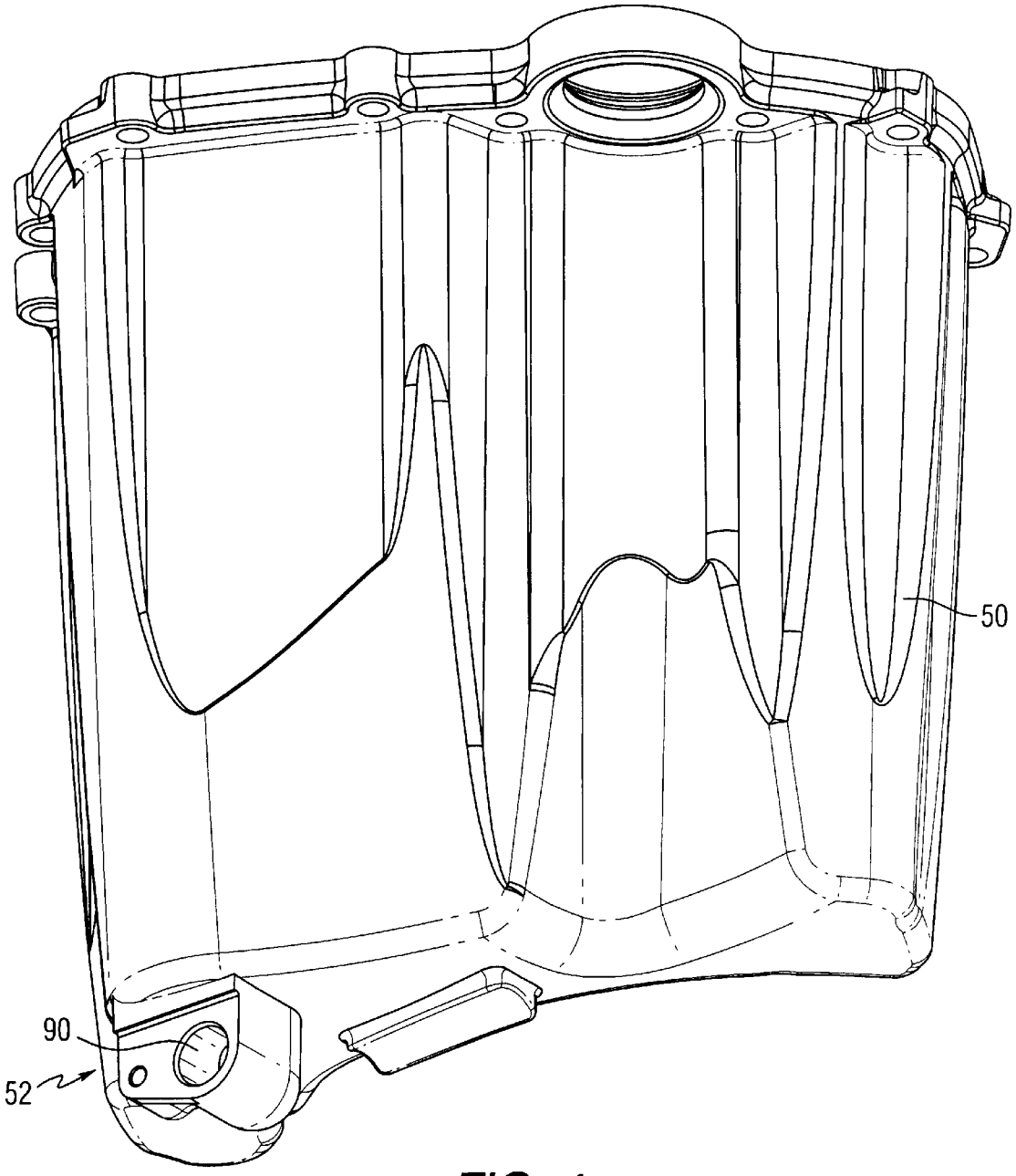
FIG. 4 is an isometric view of an oil sump reservoir used in conjunction with the present invention.

FIG. 4 is an isometric view of the oil sump reservoir 50 with the opening 94 providing fluid communication between the internal cavity of the oil sump reservoir 50 and the first end 78 of the transition drain conduit 76 which is described above in conjunction with FIG. 3. The opening 94 is located at the bottom portion 52 of the oil sump reservoir 50.

Figure 5:
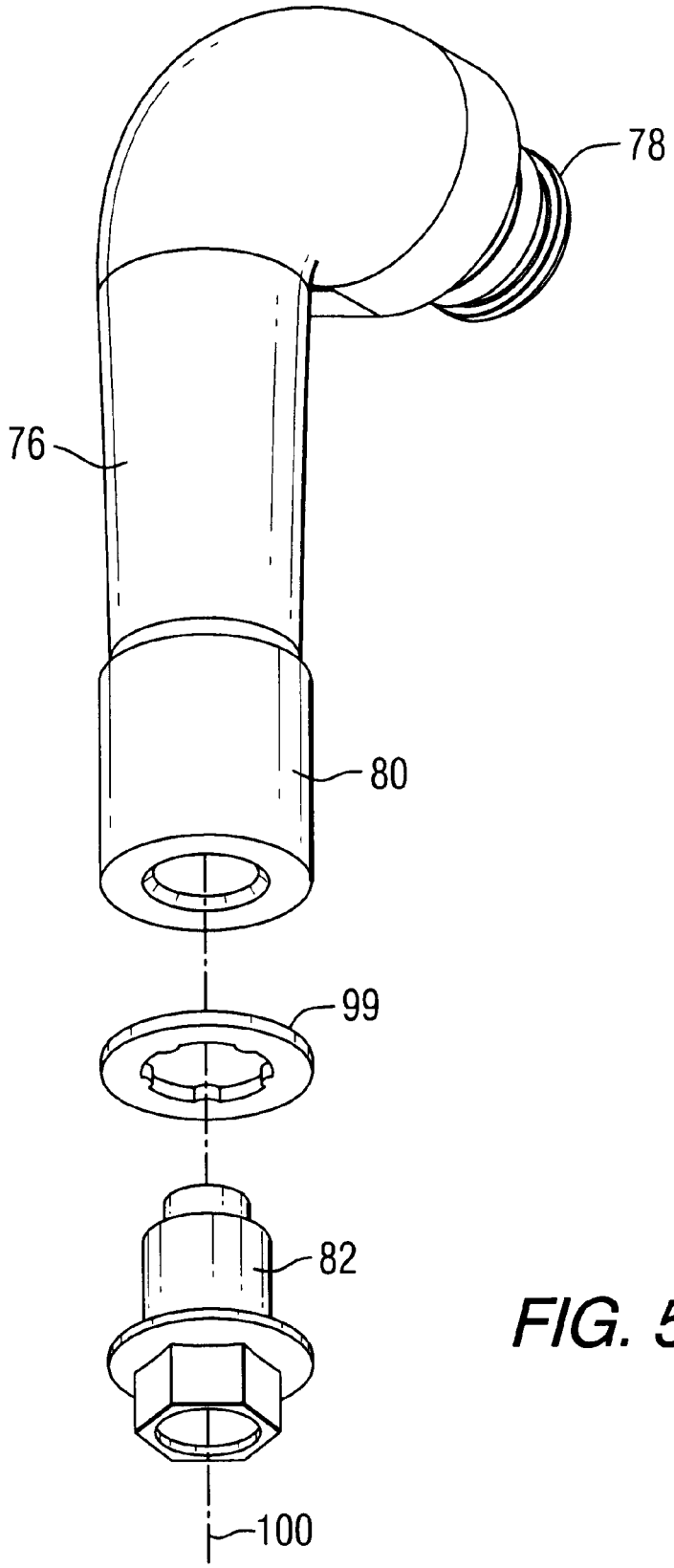
FIG. 5 is an isometric exploded view of a transition drain conduit and an associated plug.

FIG. 5 shows the transition drain conduit 76 with its first end 78 and its second end 80. The plug 82 is threadable into the female threaded second end 80 of the transition drain conduit 76. In FIG. 5, a lock washer 99 is provided to more firmly hold the plug 82 in position when it is threaded into the second end 80 of the transition drain conduit 76. Line 100 is provided in FIG. 5 to show the path along which the plug 82 is inserted into the second end 80 of the transition drain conduit 76. As described above, the first end 78 of the transition drain conduit 76 is inserted into the opening 94 described above in conjunction with FIG. 4.

Figure 6:
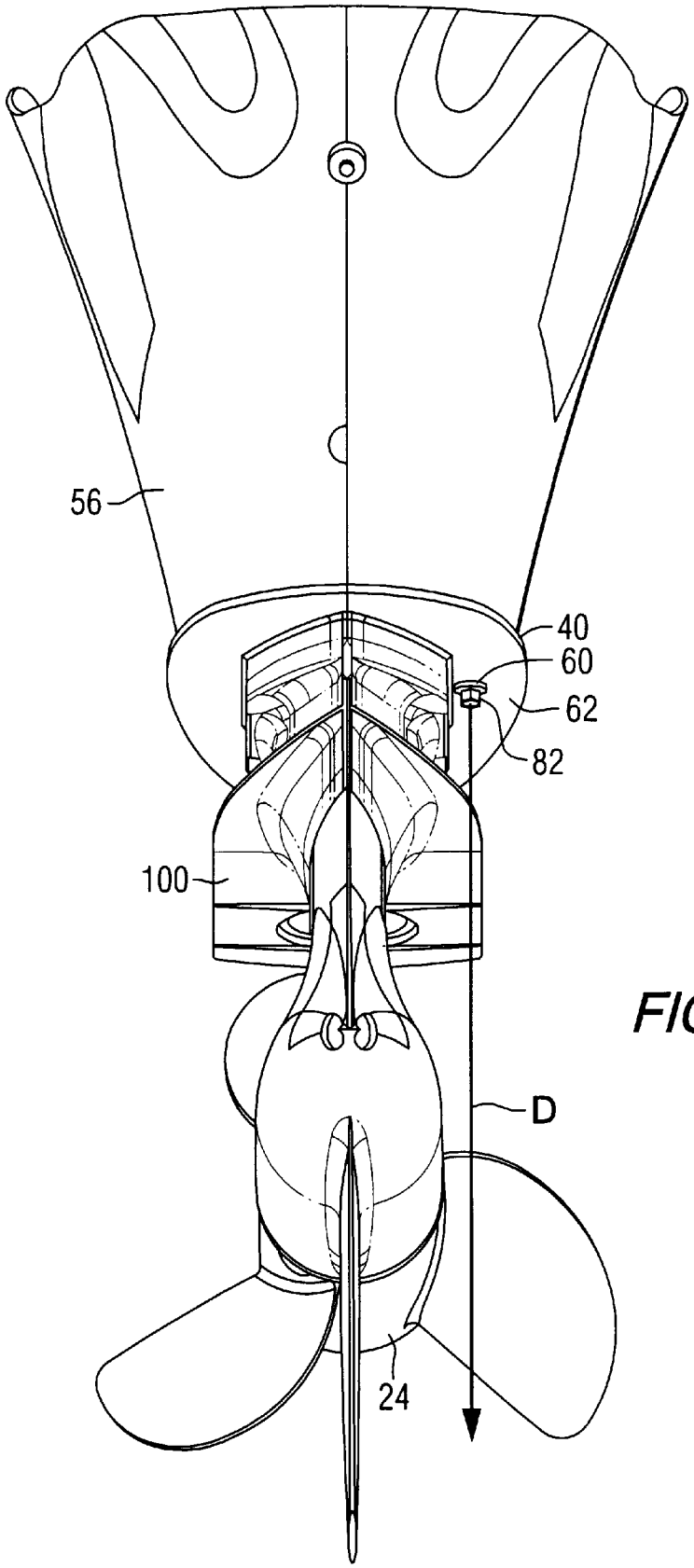
FIG. 6 is a front isometric view of a driveshaft and gearcase of an outboard motor with the oil drain opening of the present invention illustrated.

FIG. 6 is a front isometric view of the present invention, showing the driveshaft housing 56, the splash plate 40, and the oil drain opening 60 at the lower surface 62 of the splash plate 40 and with the plug 82 threaded into the second end of the transition drain conduit 76 within the oil drain opening 60. A ventilation plate 100 is located below the splash plate 40 and tapers to a pointed leading edge. Because of the location of the oil drain opening 60, oil can drain from the oil drain opening 60, when the plug 82 is removed, under the force of gravity in a direction downwardly from the oil drain opening 60 as represented by arrow D. In should be clearly understood that arrow D is FIG. 6 is coaxial and concentric with vertical line 70 illustrated in FIG. 3. Arrow D represents the path of oil, flowing under the force of gravity, from the second end 80 of the transition drain conduit 76 within the oil drain opening 60 when the plug 82 is removed. With reference to FIGS. 3 and 6, it can be seen that the flow of oil along arrow D and along vertical line 70 passes in front of the propeller 24 and to the port side of the outboard motor. More specifically, arrow D in FIG. 6 is on the port side of the gearcase 22 and in front of the propeller 24 as shown in FIG. 3. As a result, oil flowing out of the oil drain opening 60 will not strike any surface of the outboard motor and can be easily collected in a container disposed below the oil drain opening 60. That container can be placed on the ground beneath the gearcase 22 and aligned with vertical line 70 and arrow D. This presents a significant advantage over prior art oil drain systems because of the ease in oil draining that it provides and because it avoids certain messy result that could otherwise occur if prior art draining systems are used.

Figure 7:
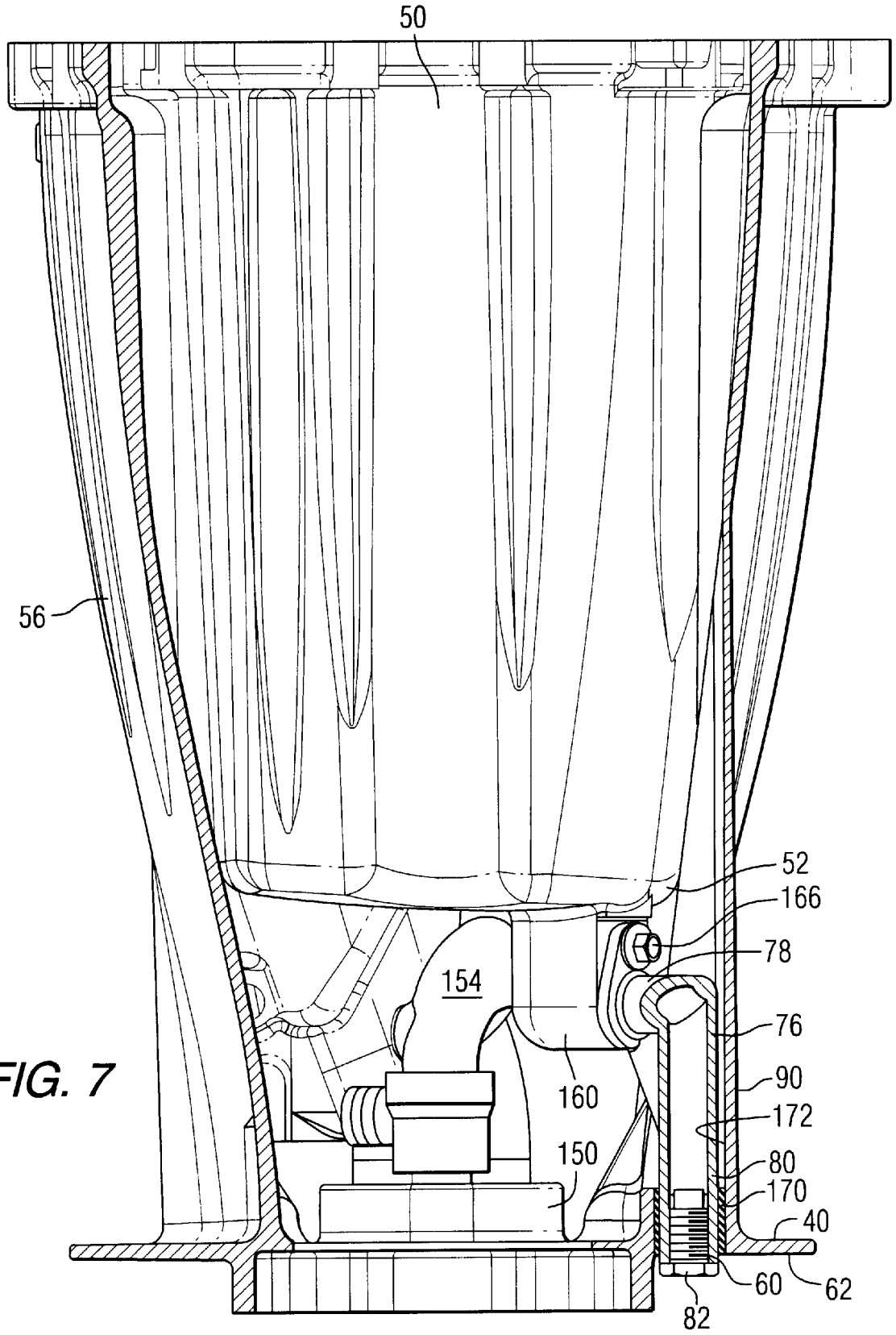
FIG. 7 is a section view of the driveshaft housing, showing the relationship between the transition drain conduit and the protective conduit housing.

FIG. 7 is a section view of the driveshaft housing 56, showing the oil sump reservoir 50 disposed within an internally formed cavity of the driveshaft housing 56. A space exists around the outer surface of the oil sump reservoir 50 and within the inner surface of the internal cavity of the driveshaft housing 56, into which the oil sump housing 50 is disposed. That surrounding space typically contains a volume of cooling water that has passed through cooling conduits of the internal combustion engine and is in transit through the driveshaft housing 56 on its way back to the body of water in which the marine vessel is operated. Also shown in FIG. 7 is a water pump 150 which draws water from the body of water in which the marine vessel is operated and causes the water to flow upwardly through a water conduit 154. Although these components are illustrated for purposes of describing the configuration of FIG. 7, it should be understood that the water pump 150 and the water conduit 154 are not required by the present invention and are not limiting thereto. At the bottom portion 52 of the oil sump reservoir 50, a downwardly extending protrusion 160 provides the opening 94, as shown in FIG. 4, into which the first end 78 of the transition drain conduit 76 is attached. The attachment is provided by the threaded member 166. As can be seen, the transition drain conduit 76 is sectioned in FIG. 7 in order to show the elastomeric seal member 170 that surrounds the outer surface of the second end 80 of the transition drain conduit 76 and provides a seal within an inner surface of the internal central passage 172 formed within the protective conduit housing 90. The elastomeric seal member 170 prevents water from leaking past the second end 80 from the water storage cavity surrounding the outer surface of the oil sump reservoir 50 and within the internal cavity of the driveshaft housing 56. As can be seen in FIG. 7, the second end 80 of the transition drain conduit 76 is generally concentric with the oil drain opening 60 formed in the bottom surface 62 of the splash plate 40. As a result of the construction illustrated in FIG. 7, oil can drain downwardly from the oil sump reservoir 50 and through the transition drain conduit 76 when the plug 82 is removed. That draining oil will drain directly downward from the oil drain opening 60 formed in the lower surface 62 of the splash plate 40.

Figure 8:
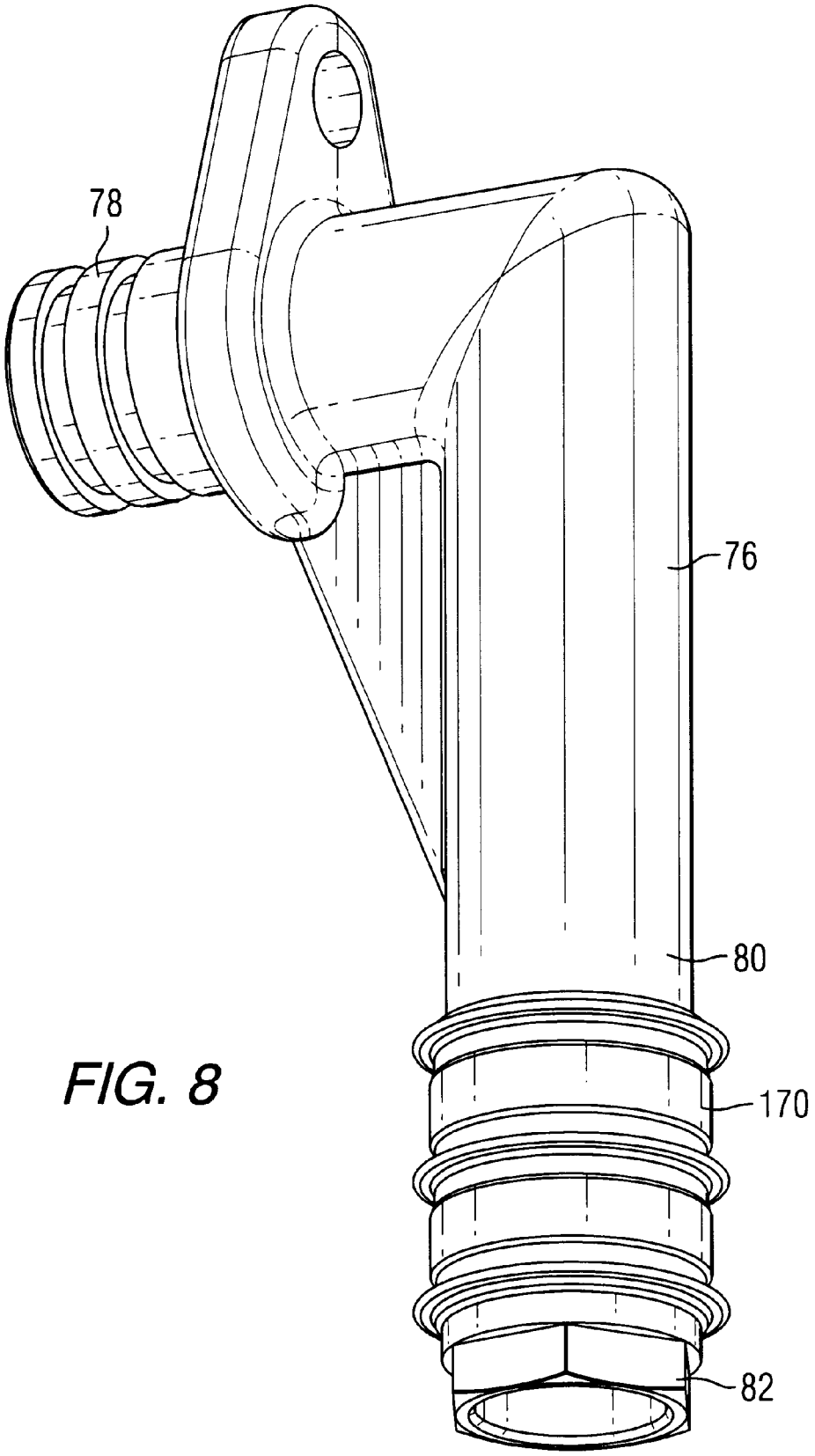
FIG. 8 is an isometric view of the transition drain conduit, its elastomeric seal, and the sealing plug.

FIG. 8 is an isometric view of the transition drain conduit 76, with its first end 78 that is shaped to be received in the opening 94 near the bottom portion 52 of the oil sump reservoir 50, as illustrated in FIG. 4, and its second end 80 which is provided with the elastomeric seal member 170 surrounding its outer cylindrical surface. The plug 82 is threaded into the second end 80 of the transition drain conduit 76. The internal central passage 172, illustrated in FIG. 7, is shaped to receive the transition drain conduit 76 within it and the oil drain opening 60 is shaped to receive the second end 80 of the transition drain conduit 76 along with its elastomeric seal member 170.

As a result of the structure of the present invention, oil can be drained from the oil sump reservoir 50, through the second end 80 of the transition drain conduit 76, through the oil drain opening 60 without allowing water to leak from the internal cavity of the driveshaft housing 56, around the outer surface of the second end 80, and out of the oil drain opening 60. Since the oil drain opening 60 and its associated second end 80 of the transition drain conduit 76 are located in the bottom surface 62 of the splash plate 40, with no components directly below them, removing the plug 82 allows oil to drain from the oil sump reservoir 50 in a direction which is directly downward from the lower surface 62 without contacting any surface of the outboard motor.

With reference to FIGS. 1 and 3–8, an oil draining system for an outboard motor, made in accordance with the preferred embodiment of the present invention, comprises an oil sump reservoir 50 having a bottom portion 52. A driveshaft housing 56 has a sump cavity which is shaped to receive the oil sump reservoir 50 therein. The driveshaft housing 56 has a plate portion 40 attached thereto or integral therewith and extending in a forward direction from the driveshaft housing 56. The oil sump reservoir 50 is disposed within the sump cavity of the driveshaft housing 56. An oil drain opening 60 is formed in a surface 62 of the plate portion 40. The oil drain opening 60 is laterally offset from all surfaces of the outboard motor 10 which are located in a direction below the plate portion 40 when the outboard motor 10 is attached to a transom 30 of a marine vessel 34. A transition drain conduit 76 has a first end 78 connected in fluid communication with an internal cavity of the oil sump reservoir 50. The transition drain conduit 76 has a second end 80 disposed within or connected in fluid communication with the oil drain opening 60. A protective conduit housing 90 is formed within the structure of the driveshaft housing 56 and has a first end 78 connected in fluid communication with the sump cavity formed inside the driveshaft housing 56. It also has a second end that extends downward through the plate portion 40 to allow the second end 80 of the transition drain conduit 76 to extend therefrom. The transition drain conduit 76 is generally L-shaped in a preferred embodiment of the present invention and extends from the body portion 52 of the oil sump reservoir 50. It is disposed within the sump cavity of the driveshaft housing 56. A plug 82 is shaped to be received in threaded association with the second end 80 of the transition drain conduit 76 and within the oil drain opening 60. The oil drain opening 60 is located at a position which is forward of the propeller 24 of the outboard motor 10 when the outboard motor 10 is attached to the transom 30 of the marine vessel 34. The oil drain opening 60 is located at a port side of the outboard motor 10 when the outboard motor 10 is attached to the transom 30 of the marine vessel 34. The flat surface 62 of the plate portion 40 is generally horizontal when the outboard motor 10 is attached to the transom 30 of the marine vessel 34 and the oil drain opening 60 is formed within that flat surface. The plate portion 50 is a splash plate of an outboard motor in a preferred embodiment of the present invention.

Although the present invention has been described in particular detail and illustrated to show a preferred embodiment, it should be understood that alternative embodiments are also within its scope.

We claim:

1. An oil draining system for an outboard motor, comprising:

an oil sump reservoir having a bottom portion;

a drive shaft housing, said oil sump reservoir being disposed within said drive shaft housing;

an oil drain opening formed in a surface of said outboard motor, said surface being generally horizontal when said outboard motor is attached to a transom of a marine vessel, said oil drain opening being disposed below all other portions of said outboard motor which are intersected by a vertical line through said oil drain opening when said outboard motor is attached to said transom of said marine vessel, whereby liquid oil draining from said oil drain opening under the force of gravity along said vertical line will not contact any of said other portions of said outboard motor.

2. The oil draining system of claim 1, wherein:

said surface is a lower surface of a splash plate of said outboard motor; and said oil drain opening is laterally offset from all surfaces of said outboard motor which are located in a direction below said splash plate when said outboard motor is attached to said transom of said marine vessel.

3. The oil draining system of claim 1, wherein:

said oil sump reservoir is a separate container which is disposed in a cavity of said drive shaft housing which is shaped to receive said oil sump reservoir.

4. The oil draining system of claim 3, further comprising:

a transition drain conduit having a first end connected in fluid communication with an internal cavity of said oil sump reservoir, said transition drain conduit having a second end disposed within said oil drain opening.

5. The oil draining system of claim 4, further comprising:

a protective conduit housing integrally formed within the structure of said drive shaft housing and having a first end shaped to receive said transition drain conduit, said protective conduit housing having a second end shaped to receive said second end of said transition drain conduit.

6. The oil draining system of claim 5, wherein:

said protective conduit housing is contained within a protruding rib which is formed as part of said drive shaft housing and which extends from said second end of said protective conduit housing which is proximate said plate portion to said first end of said protective conduit housing which is proximate said oil sump reservoir.

7. The oil draining system of claim 6, wherein:

said transition drain conduit is generally L-shaped and extends from said bottom portion of said oil sump reservoir.

8. The oil draining system of claim 6, wherein:

said transition drain conduit is disposed partially within said sump cavity of said drive shaft housing.

9. The oil draining system of claim 1, further comprising:

a plug which is shaped to be received in threaded association by said second end of said transition drain conduit.

10. The oil draining system of claim 1, wherein:

said oil drain opening is located at a position which is forward of a propeller of said outboard motor when said outboard motor is attached to said transom of said marine vessel.

11. The oil draining system of claim 1, wherein:

said oil drain opening is located at a port side of said outboard motor when said outboard motor is attached to said transom of said marine vessel.

12. An oil draining system for an outboard motor, comprising:

an oil sump reservoir having a bottom portion;

a drive shaft housing having a sump cavity which is shaped to receive said oil sump reservoir therein, said drive shaft housing having a plate portion attached thereto and extending in a forward direction from said drive shaft housing, said oil sump reservoir being disposed within said sump cavity;

an oil drain opening formed in a surface of said plate portion, said oil drain opening being laterally offset from all surfaces of said outboard motor which are located in a direction below said plate portion when said outboard motor is attached to a transom of a marine vessel; and a transition drain conduit having a first end connected in fluid communication with an internal cavity of said oil sump reservoir, said transition drain conduit having a second end connected in fluid communication with said oil drain opening.

13. The oil draining system of claim 12, further comprising:

a protective conduit housing formed within the structure of said drive shaft housing having a first end shaped to receive said transition drain conduit, said protective conduit housing having a second end shaped to receive said second end of said transition drain conduit.

14. The oil draining system of claim 13, wherein:

said protective conduit housing is contained within a protruding rib which is formed as part of said drive shaft housing.

15. The oil draining system of claim 12, wherein:

said transition drain conduit is generally L-shaped and extends from said bottom portion of said oil sump reservoir.

16. The oil draining system of claim 12, wherein:

said transition drain conduit is disposed partially within said sump cavity of said drive shaft housing.

17. The oil draining system of claim 12, further comprising:

a plug which is shaped to be received in threaded association within said second end of said transition drain conduit.

18. The oil draining system of claim 12, wherein:

said oil drain opening is located at a position which is forward of a propeller of said outboard motor when said outboard motor is attached to said transom of said marine vessel.

19. The oil draining system of claim 12, wherein:

said oil drain opening is located at a port side of said outboard motor when said outboard motor is attached to said transom of said marine vessel.

20. The oil draining system of claim 12, wherein:

a flat surface of said plate portion is generally horizontal when said outboard motor is attached to said transom of said marine vessel, said oil drain being formed in said flat surface.

21. The oil draining system of claim 12, wherein:

said plate portion is a splash plate of said outboard motor.

22. An oil draining system for an outboard motor, comprising:

an oil sump reservoir having a bottom portion;

a drive shaft housing having a sump cavity which is shaped to receive said oil sump reservoir therein, said drive shaft housing having a splash plate attached thereto and extending in a forward direction from said drive shaft housing, said oil sump reservoir being disposed within said sump cavity;

an oil drain opening formed in a surface of said splash plate, said oil drain opening being laterally offset from all surfaces of said outboard motor which are located in a direction below said splash plate when said outboard motor is attached to a transom of a marine vessel, said surface being an underside surface of said splash plate when said outboard motor is attached to said transom of said marine vessel; and a transition drain conduit having a first end connected in fluid communication with an internal cavity of said oil sump reservoir, said transition drain conduit having a second end disposed within said oil drain opening.

23. The oil draining system of claim 22, further comprising:

a protective conduit housing formed within the structure of said drive shaft housing having a first end shaped to receive said transition drain conduit, said protective conduit housing having a second end shaped to receive said second end of said transition drain conduit.

24. The oil draining system of claim 23, wherein:

said protective conduit housing is contained within a protruding rib which is formed as part of said drive shaft housing.

25. The oil draining system of claim 24, wherein:

said transition drain conduit is generally L-shaped and extends from said bottom portion of said oil sump reservoir.

26. The oil draining system of claim 25, wherein:

said transition drain conduit is disposed partially within said sump cavity of said drive shaft housing.

27. The oil draining system of claim 26, further comprising:

a plug which is shaped to be received in threaded association by said second end of said transition drain conduit.

28. The oil draining system of claim 27, wherein:

said oil drain opening is located at a position which is forward of a propeller of said outboard motor when said outboard motor is attached to said transom of said marine vessel.

29. The oil draining system of claim 28, wherein:

said oil drain opening is located at a port side of said outboard motor when said outboard motor is attached to said transom of said marine vessel.

* * * * *